US009284157B2

(12) United States Patent
Won

(10) Patent No.: US 9,284,157 B2
(45) Date of Patent: Mar. 15, 2016

(54) IMAGE FORMING APPARATUS CAPABLE OF DUPLEX PRINTING

(75) Inventor: Jung-yun Won, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 341 days.

(21) Appl. No.: 12/923,440

(22) Filed: Sep. 21, 2010

(65) Prior Publication Data

US 2011/0085838 A1 Apr. 14, 2011

(30) Foreign Application Priority Data

Oct. 12, 2009 (KR) ..... 10-2009-0096902

(51) Int. Cl.

*G03G 15/00* (2006.01)
*B65H 85/00* (2006.01)
*G03G 15/23* (2006.01)

(52) U.S. Cl.

CPC ..... *B65H 85/00* (2013.01); *G03G 15/234* (2013.01); *G03G 15/6552* (2013.01)

(58) Field of Classification Search

CPC ..... G03G 15/234; G03G 21/1628; G03G 2215/00586; G03G 2215/2083; G03G 15/6552; B65H 2301/3331; B65H 2301/333; B65H 2404/14; B65H 2404/142; B65H 2404/144; B65H 2404/14212; B65H 2404/143; B65H 2404/1441; B65H 2601/255; B65H 2601/261; B65H 85/00

USPC ..... 399/401, 397, 167, 162; 271/225

See application file for complete search history.

(56) References Cited

U.S. PATENT DOCUMENTS

| | | | | |
|---|---|---|---|---|
| 5,449,160 | A * | 9/1995 | Hou et al. | 271/3.15 |
| 5,532,793 | A * | 7/1996 | Kogure | 399/19 |
| 5,974,298 | A * | 10/1999 | Urban et al. | 399/401 |
| 6,571,074 | B2 * | 5/2003 | Suzuki et al. | 399/124 |
| 2005/0254871 | A1 * | 11/2005 | Kim | 399/401 |

FOREIGN PATENT DOCUMENTS

| | | | |
|---|---|---|---|
| JP | 05040374 | A * | 2/1993 |
| JP | 2000-29252 | | 1/2000 |
| KR | 10-2005-0110060 | | 11/2005 |

OTHER PUBLICATIONS

Korean Office Action issued Nov. 9, 2015 in corresponding Korean Application No. 10-2009-0096902.

* cited by examiner

*Primary Examiner* — Matthew G Marini
(74) *Attorney, Agent, or Firm* — Staas & Halsey LLP

(57) ABSTRACT

A duplex-printable image forming apparatus which is capable of increasing a speed of duplex printing. The image forming apparatus includes: a developing unit which forms a visible image, which is formed of a developer, on a printing medium; a fixing unit which fixes the visible image formed on the printing medium onto the printing medium; a discharging roller unit which can be regularly/reversely rotated such that the printing medium passed through the fixing unit is conveyed to the developing unit along a duplex printing path or is discharged out of the apparatus; and an intermediate conveying unit which is interposed between the fixing unit and the discharging roller unit and selectively holds the printing medium.

12 Claims, 9 Drawing Sheets

IMAGE FORMING APPARATUS CAPABLE OF DUPLEX PRINTING

CROSS-REFERENCE TO RELATED APPLICATIONS

This application claims priority from Korean Patent Application No. 10-2009-0096902, filed on Oct. 12, 2009 in the Korean Intellectual Property Office, the disclosure of which is incorporated herein by reference.

BACKGROUND

1. Field

Devices consistent with the present embodiment relate to an image forming apparatus capable of duplex printing, and more particularly, to a duplex-printable image forming apparatus which is capable of increasing a speed of duplex printing.

2. Description of the Related Art

In recent business environments, image forming apparatuses with duplex printability have been basically employed for protection of the environment and conservation of resources, and users and purchasers are demanding a small-sized image forming apparatus equipped with optimal printing capabilities, as well as all basic functionalities. To keep pace with this, efforts have been increasingly made to minimize a space within image forming apparatuses without deteriorating their performance.

In conventional image forming apparatuses with duplex printability, for simplex printing, a printing medium is fed from a feeding unit to a developing unit on which a visible image composed of a developer is formed. Thereafter, the printing medium is carried to a fixing unit by which the visible image is fixed onto the printing medium. The printing medium onto which the image has been fixed is discharged through a discharging roller adjacent to a discharging port, thereby allowing a user to obtain a print on which a desired image has been formed.

In the conventional image forming apparatuses with duplex printability, for duplex printing, the printing medium with its front side printed is partially discharged to a discharging unit and then reenters the image forming apparatus when the discharging roller is reversely rotated. The reentered printing medium enters a duplex printing path, is guided to the feeding unit, and then enters a developing roller. Then, a duplex printing is performed as a developer is applied on the rear side of the entered printing medium.

In the conventional image forming apparatuses with duplex printability, when the duplex printing is performed for a plurality of printing media, after duplex printing for a first printing medium is completed, a following second printing medium is duplex-printed.

Instead of the above method, in order to increase duplex printing efficiency, for an image forming apparatus with a sufficiently large size, a method of printing a front side of a second printing medium before printing a rear side of a first printing medium after printing a front side of the first printing medium is currently being used. Specifically, in this method, a conveying path through which printing media pass is formed to be sufficiently long, and the second printing medium is fed from a feeder and passes through a developing unit and a fixing unit while the first printing medium is being conveyed along a duplex printing path for rear side printing after the front side of the first printing medium is printed.

However, although this method may increase printing efficiency, the size of the image forming apparatus may increase since the conveying path has to be sufficiently secured such that the first printing medium does not overlap the second printing medium.

In addition, if the first and second printing media reside in the same path, the printing media are likely to be jammed.

SUMMARY

Accordingly, it is an aspect of the present embodiment to provide an image forming apparatus which is capable of increasing printing efficiency for duplex printing.

Another aspect of the present embodiment is to provide an image forming apparatus which is capable of performing duplex printing without jamming even if a printing medium carrying path is decreased.

Still another aspect of the present embodiment is to provide an image forming apparatus which is capable of reducing a product size.

Additional aspects will be set forth in part in the description which follows and, in part, will be apparent from the description, or may be learned by practice of the present invention.

The foregoing and/or other aspects can be achieved by providing an image forming apparatus including: a developing unit which forms a visible image, which is formed of a developer, on a printing medium; a fixing unit which fixes the visible image formed on the printing medium onto the printing medium; a discharging roller unit which can be regularly/reversely rotated such that the printing medium passed through the fixing unit is conveyed to the developing unit along a duplex printing path or is discharged out of the apparatus; and an intermediate conveying unit which is interposed between the fixing unit and the discharging roller unit and selectively holds the printing medium.

The intermediate conveying unit may include: first and second conveying rollers which are disposed with the printing medium interposed between the first and second conveying rollers; and a driving unit which drives at least one of the first and second conveying rollers such that one of the first and second conveying rollers is close to and isolated from the other.

The driving unit may include: a support lever which supports at least one of shafts of the first and second conveying rollers and allows the first and second conveying rollers to be close to and isolated from each other; and a solenoid which actuates the support lever.

One of the first and second conveying rollers may be rotatably moved to be close to and isolated from the other.

One of the first and second conveying rollers may be slidably moved to be close to and isolated from the other.

The image forming apparatus may further include a control unit which controls the driving unit to isolate the first conveying roller from the second conveying roller if a first printing medium being conveyed in the duplex printing path overlaps a following second printing medium passed through the fixing unit at a position at which the intermediate conveying unit is disposed.

The first conveying roller may be a driving roller and the second conveying roller may be a driven roller which is rotated relying on the first conveying roller.

The first conveying roller may be driven to be rotated in the same direction as a driving roller of the discharging roller unit.

According to an aspect, it is possible to perform a duplex printing without jamming even if a printing medium carrying path becomes decreased.

According to an aspect, it is possible to reduce a product size.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION

Figure 1:
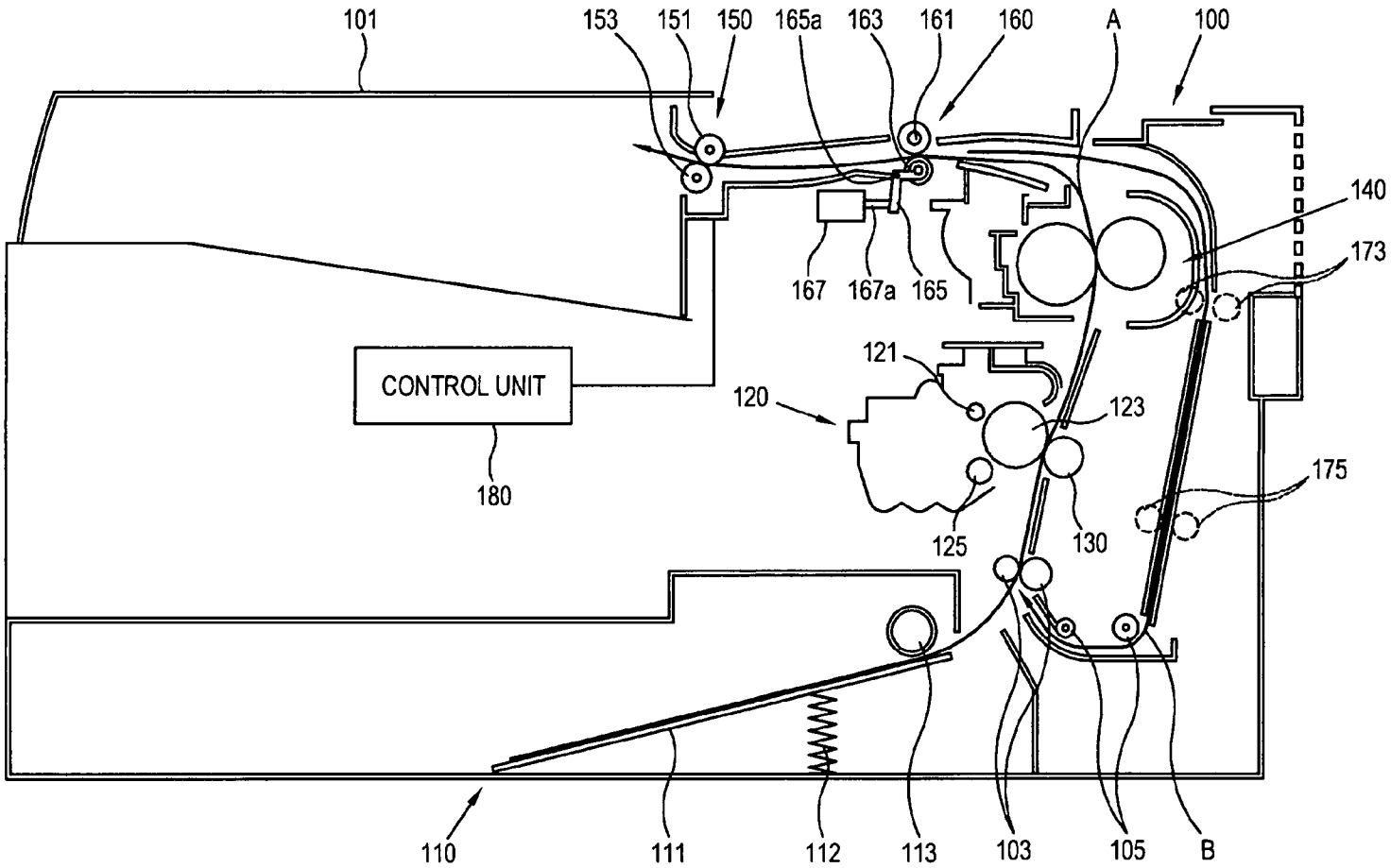
FIG. 1 is a schematic sectional view of an image forming apparatus according to an exemplary embodiment.

Reference will now be made in detail to the embodiment, examples of which are illustrated in the accompanying drawings, so that those in the art can easily practice the present invention. The present invention is not limited to the exemplary embodiment disclosed herein, but may be implemented in different forms.

In the following embodiments, for the purpose of clarity, the same components are denoted by the same reference numerals throughout the drawings, and explanation thereof will be representatively given in a first embodiment but will be omitted in other embodiments.

As shown in FIG. 1, an image forming apparatus 100 according to an exemplary embodiment includes a body 101; a developing cartridge 120 attachable/detachable to/from the body 101; a transfer roller 130 facing an image carrier 123 of the developing cartridge 120; a fixing unit 140; a discharging roller unit 150; and an intermediate conveying unit 160 interposed between the fixing unit 140 and the discharging roller unit 150.

The developing cartridge 120 includes the image carrier 123; a charge roller 121 that charges the surface of the image carrier 123 to a uniform potential; and a developing roller 125 that develops the image carrier 123, with its surface exposed by an exposure unit (not shown), using a developer.

Developers of predetermined different colors may be stored in the developing cartridge 120. Alternatively, developers may be supplied from a separate developer tank, which stores the developers, into the developing cartridge 120.

A visible image on the image carrier 123 is transferred onto a printing medium passing between the image carrier 123 and the transfer roller 130 by the transfer roller 130. Accordingly, the visible image is formed on the printing medium.

Here, a developing unit may include the developing cartridge 120 and the transfer roller 130.

Here, the image forming apparatus 100 may further include a printing medium supplying unit 110, which supplies the printing medium.

The printing medium supplying unit 110 is provided to be attachable/detachable to/from the body 101.

The printing medium supplying unit 110 includes a knock-up plate 111 on which the printing medium is loaded; a pick-up roller 113 that picks up the printing medium to be conveyed to a registration roller 103; and an elastic member 112 that elastically biases a front end portion of the knock-up plate 111 to the pick-up roller 113.

The registration roller 103 aligns a leading end of the printing medium conveyed from the printing medium supplying unit 110 or through a duplex printing path and conveys the aligned printing medium between the image carrier 123 and the transfer roller 130 at a predetermined timing. The predetermined timing is properly determined in consideration of an exposure timing of the exposure unit (not shown), a rotation speed of the image carrier 123, etc.

The visible image onto which the printing medium is transferred is fixed onto the printing medium by virtue of heat and pressure applied by the fixing unit 140.

Accordingly, one side of the printing medium is printed.

For a simplex printing mode, the one side-printed printing medium is discharged out of the apparatus through the intermediate conveying unit 160 and the discharging roller unit 150.

The discharging roller unit 150 includes a pair of rollers 151 and 153.

One of the pair of rollers 151 and 153 may be a driving roller 151 and the other may be a driven roller 153.

The intermediate conveying unit 160 may selectively hold the printing medium.

In more detail, the intermediate conveying unit 160 may include a pair of opposing first and second conveying rollers 161 and 163.

Here, both of the first and second conveying rollers 161 and 163 may not necessarily be circular rollers whose outer surface is surrounded by an elastic layer. For example, only the first conveying roller 161 may be a roller, while the second conveying roller 163 may be replaced with a fixed plate (not shown) engaging the first conveying roller 161.

In other words, the first and second conveying roller 161 and 163 may be modified in various forms as long as they can hold a printing medium interposed therebetween.

In addition, at least one of the first and second conveying rollers 161 and 163 is movable in such a manner that one of the rollers becomes close to or far away from the other.

As an alternative, the first conveying roller 161 may be a driving roller, while the second conveying roller 163 may be a driven roller rotatably driven when the second conveying roller 163 approaches and engages the first conveying roller 161.

Here, the first conveying roller 161 as the driving roller may be driven to have the same rotation direction as the driving roller 151 of the discharging roller unit 150. In other words, the driving roller 151 and the first conveying roller 161 may be provided to gear with each other by a single motor in such a manner that the rollers 151, 161 have the same rotation direction.

The intermediate conveying unit 160 may further include a driving unit 165 and 167, which drives at least one of the first and second conveying rollers 161 and 163 so that the first and second conveying rollers 161 and 163 can be engaged/released with/from each other.

The driving unit 165 and 167 may drive at least one of the first and second conveying rollers 161 and 163 in such a manner that one of the first and second conveying rollers 161 and 163 becomes close to or far away from the other.

Here, the driving unit 165 and 167 may include a movable support lever 165 which supports at least one of the shafts of the first and second conveying rollers 161 and 163 and a solenoid 167 which actuates the support lever 165.

In this embodiment, any driving mechanism, such as a cam or the like, may be employed instead of the solenoid 167.

The support lever 165 may be rotatably provided around a hinge 165*a*. In some cases, the support lever 165 may be provided to be slidably moved.

A plunger 167*a* of the solenoid 167 is connected to one end portion of the support lever 165. The support lever 165 is rotated around the hinge 165*a* in interlock with reciprocation of the plunger 167*a*. Accordingly, the second conveying roller 163 axially supported by the support lever 165 can become rotatably close to and far away from the first conveying roller 161.

The image forming apparatus 100 may include a control unit 180 which controls the solenoid 167. In this embodiment, the control unit 180 may control the whole of the printing procedures which have been described above and will be described below.

For the duplex printing, when a first printing medium overlaps a following second printing medium, the control unit 180 may control the driving unit, particularly the solenoid 167, so that the first and second conveying rollers 161 and 163 are isolated from each other.

In addition, a duplex printing path B may include rollers 105 to convey the printing medium back to a simplex printing path A.

Hereinafter, sequential procedures in which a first printing medium and a following second printing medium are duplex-printed at once will be described with reference to FIGS. 2 to 9.

Figure 2:
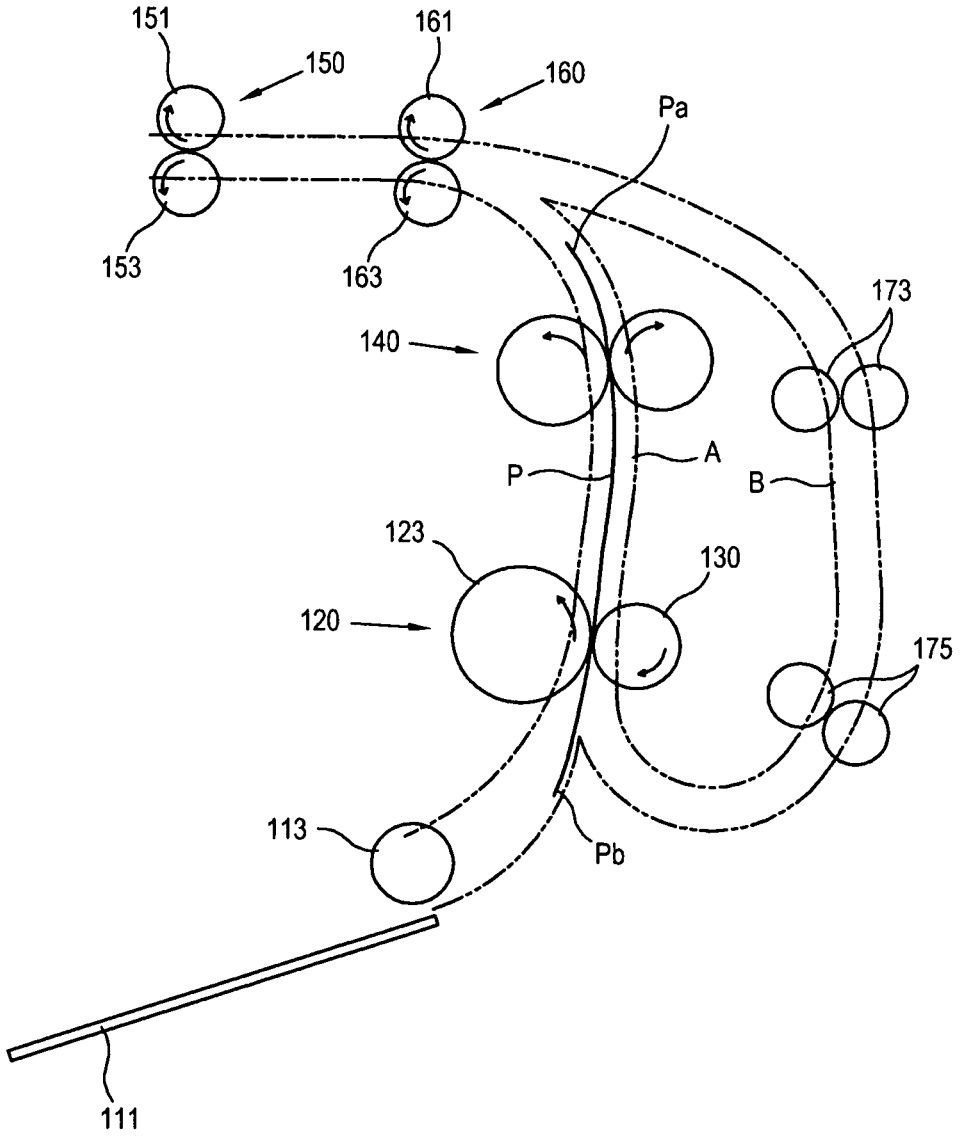
FIGS. 2 to 9 are main part schematic views showing sequential procedures in which a first printing medium and a second printing medium are duplex-printed at once in the image forming apparatus of FIG. 1.

As shown in FIG. 2, a first printing medium P on the knock-up plate 111 is picked up by the pick-up roller 113 and its one side begins to be printed while passing between the image carrier 123 and the transfer roller 130 and then passing through the fixing unit 140. The front end portion Pa of the first printing medium P passed through the fixing unit 140 is conveyed toward the intermediate conveying unit 160 and the discharging roller unit 150.

Figure 3:
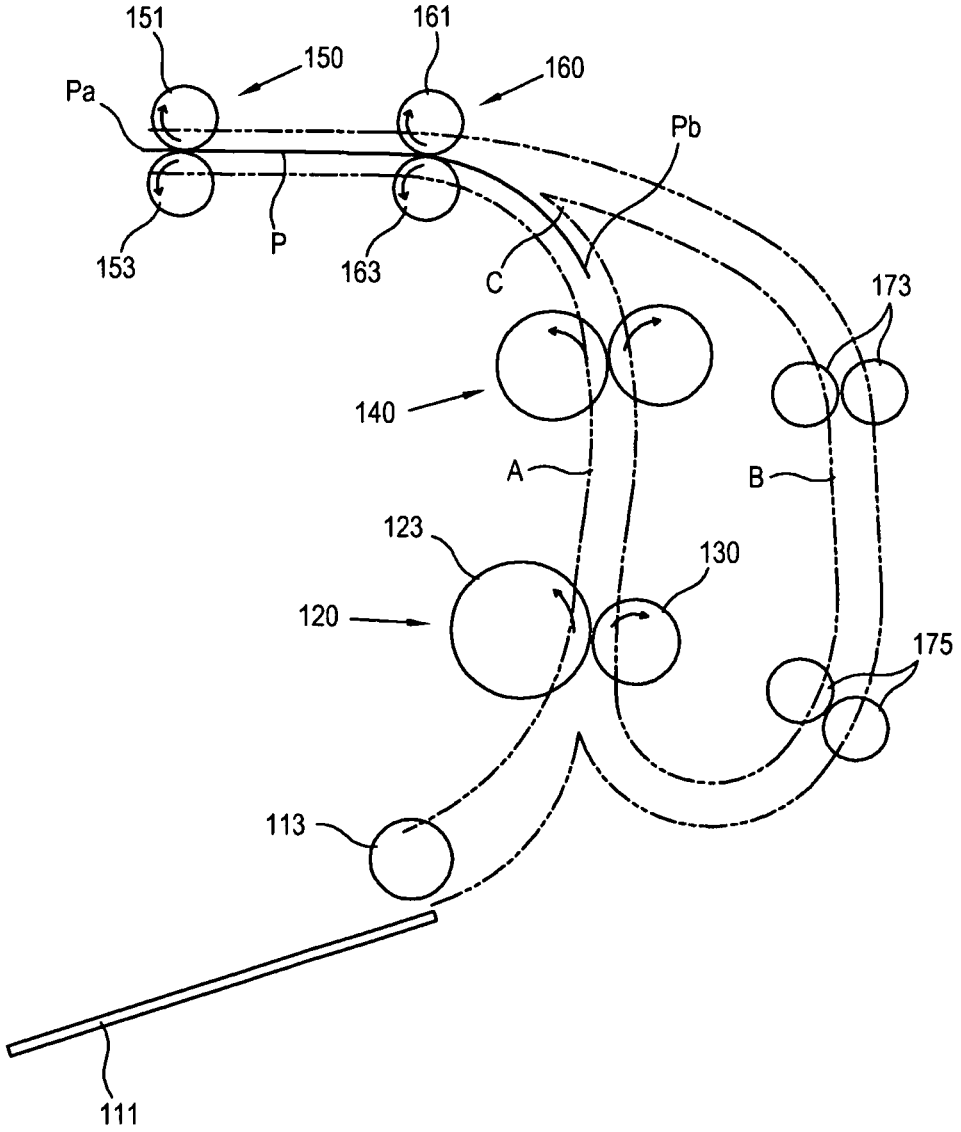

As shown in FIG. 3, the intermediate conveying unit 160 and the discharging roller unit 150 are regularly rotated to convey the first printing medium P so that the rear end portion Pb of the first printing medium P can be conveyed up to a joining point C of a simplex printing path A and a duplex printing path B.

Figure 4:
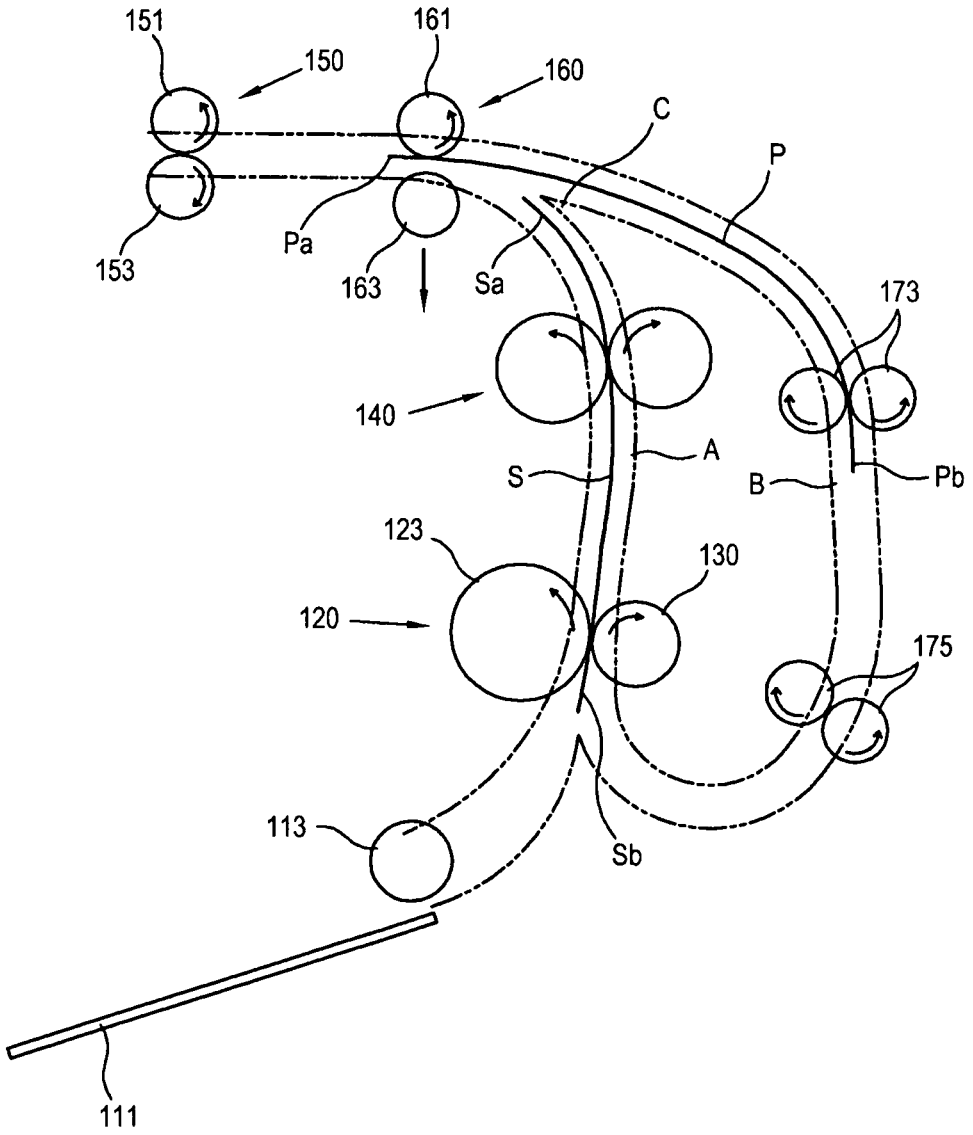

As shown in FIG. 4, after the rear end portion Pb of the first printing medium P is conveyed up to the joining point C, the discharging roller unit 150 is reversely rotated to convey the first printing medium P toward the duplex printing path B.

When the rear end portion Pb of the first printing medium P passes through the fixing unit 140, a following second printing medium S can be picked up by the pick-up roller 113. In this embodiment, an interval between the point of time when the first printing medium P is picked up and the point of time when the second printing medium S is picked up may be properly determined such that the first printing medium P can be conveyed from a position in which the intermediate conveying unit 160 is disposed in the direction of the duplex printing path B and the second printing medium S can be conveyed along the simplex printing path A.

Here, the discharging roller unit 150 is reversely rotated until the rear end portion Pb of the first printing medium P, which is being conveyed in the duplex printing path B, is held by a first duplex roller 173 disposed in the duplex printing path B.

If a front end portion Sa of the second printing medium S is passed through the fixing unit 140, there may be a case where some region of the first printing medium P overlaps the front end portion Sa of the second printing medium S at the position of the intermediate conveying unit 160.

In this case, the control unit 180 (FIG. 1) controls the solenoid 167 to isolate the first conveying roller 161 from the second conveying roller 163.

Accordingly, a passage through which the first printing medium P and the second printing medium S can simultaneously pass is provided between the first and second conveying rollers 161 and 163. This prevents jamming due to interference between the first and second printing media P and S.

Here, when the first printing medium P completes overlapping the second printing medium S, in other words, after the front end portion Pa of the first printing medium P escapes from the position of the intermediate conveying unit 160, the second conveying roller 163 is controlled to approach the first conveying roller 161.

Figure 5:
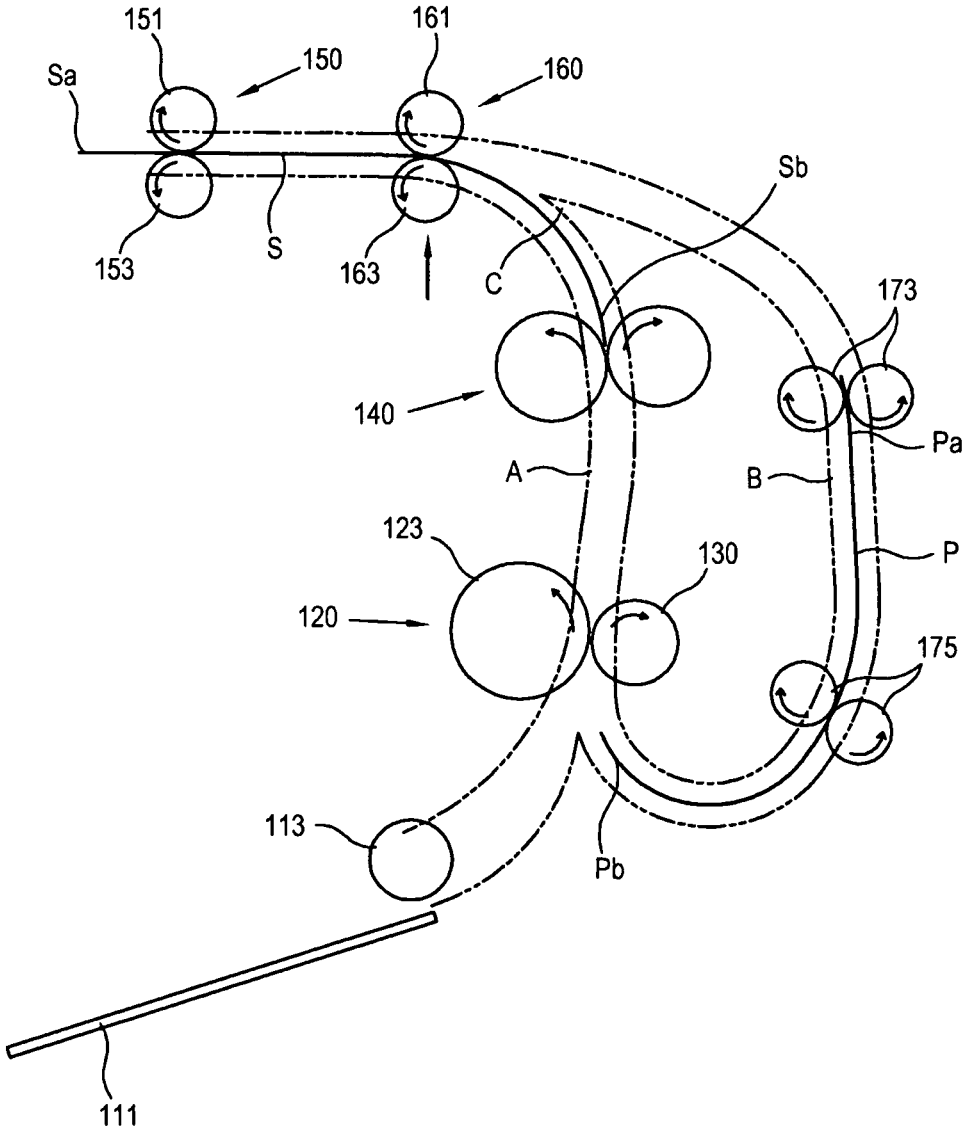

Next, as shown in FIG. 5, the first printing medium P, which is being conveyed to the duplex printing path B after escaping from the position of the intermediate conveying unit 160, is again conveyed between the image carrier 123 and the transfer roller 130 via the first duplex roller 173 and a second duplex roller 175.

At the same time, the second printing medium S is conveyed in a discharging direction by the first and second conveying rollers 161 and 163 that engage with each other. The second printing medium S is conveyed in a direction in which the medium S is discharged by the discharging roller unit 150 until a rear end portion Sb of the second printing medium S is conveyed beyond the joining point C.

Figure 6:
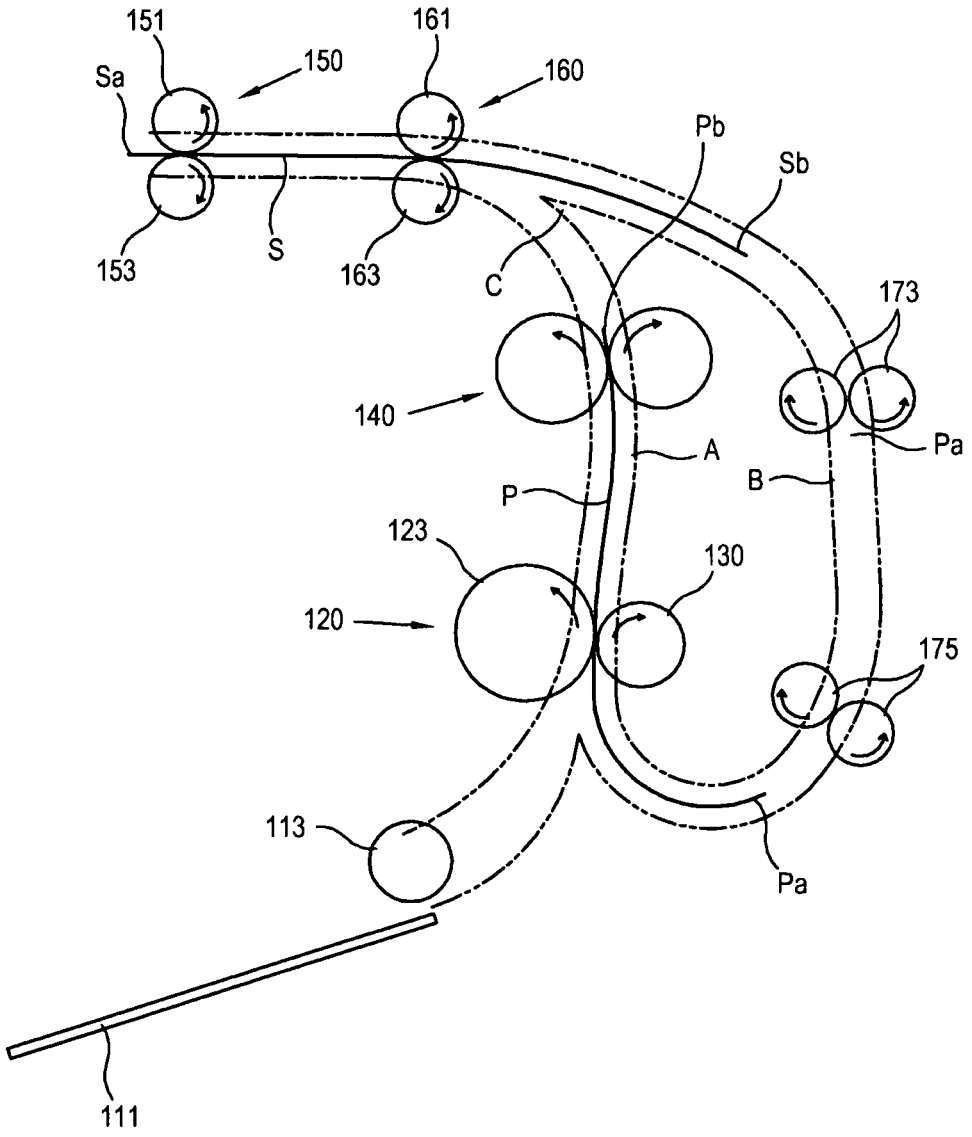

Next, as shown in FIG. 6, as the discharging roller unit 150 is reversely rotated, the second printing medium S is conveyed toward the duplex printing path B. Here, the discharging roller unit 150 is reversely rotated to convey the second printing medium S until the rear end portion Sb of the second printing medium S is held by the first duplex roller 173.

At the same time, the rear side of the first printing medium P is printed while the first printing medium P passes between the image carrier 123 and the transfer roller 130 and through the fixing unit 140.

Figure 7:
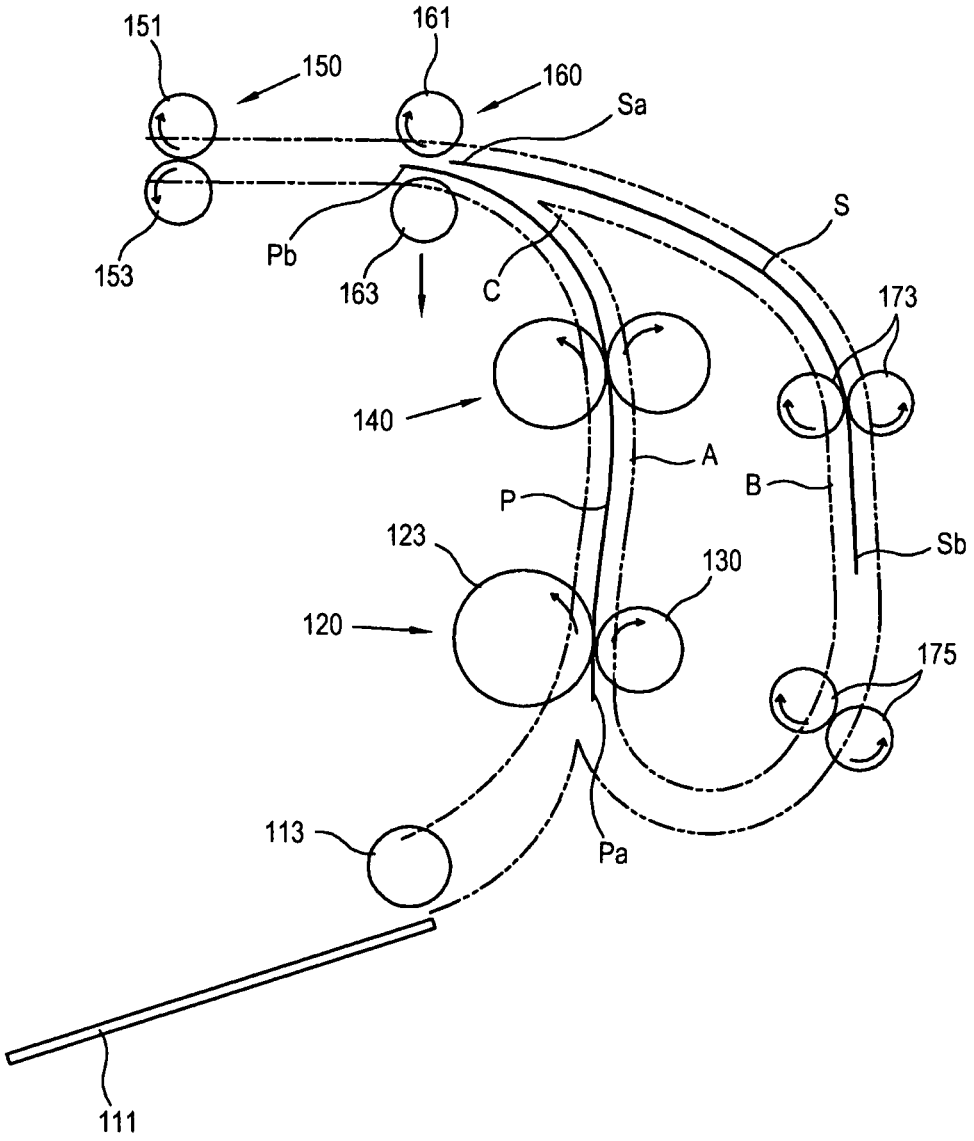

As shown in FIG. 7, the control unit 180 (FIG. 1) controls the solenoid 167 to separate the first conveying roller 161 from the second conveying roller 163 at the point of time when the rear side of the first printing medium P conveyed toward the intermediate conveying unit 160, which is being printed, overlaps the second printing medium S conveyed toward the duplex printing path B.

This prevents jamming due to interference between the first printing medium P and the second printing medium S.

When the front end portion Sa of the second printing medium S passes through the joining point C and the second printing medium S completely enters the duplex printing path B, the control unit 180 (FIG. 1) can control the solenoid 167 to cause the second conveying roller 163 to approach the first conveying roller 161. Here, the point of time when the first conveying roller 161 is close to and separated from the second conveying roller 163 may be set in various ways as long as the two printing media P and S at the position of the intermediate conveying unit 160 can simultaneously pass through the intermediate conveying unit 160.

Figure 8:
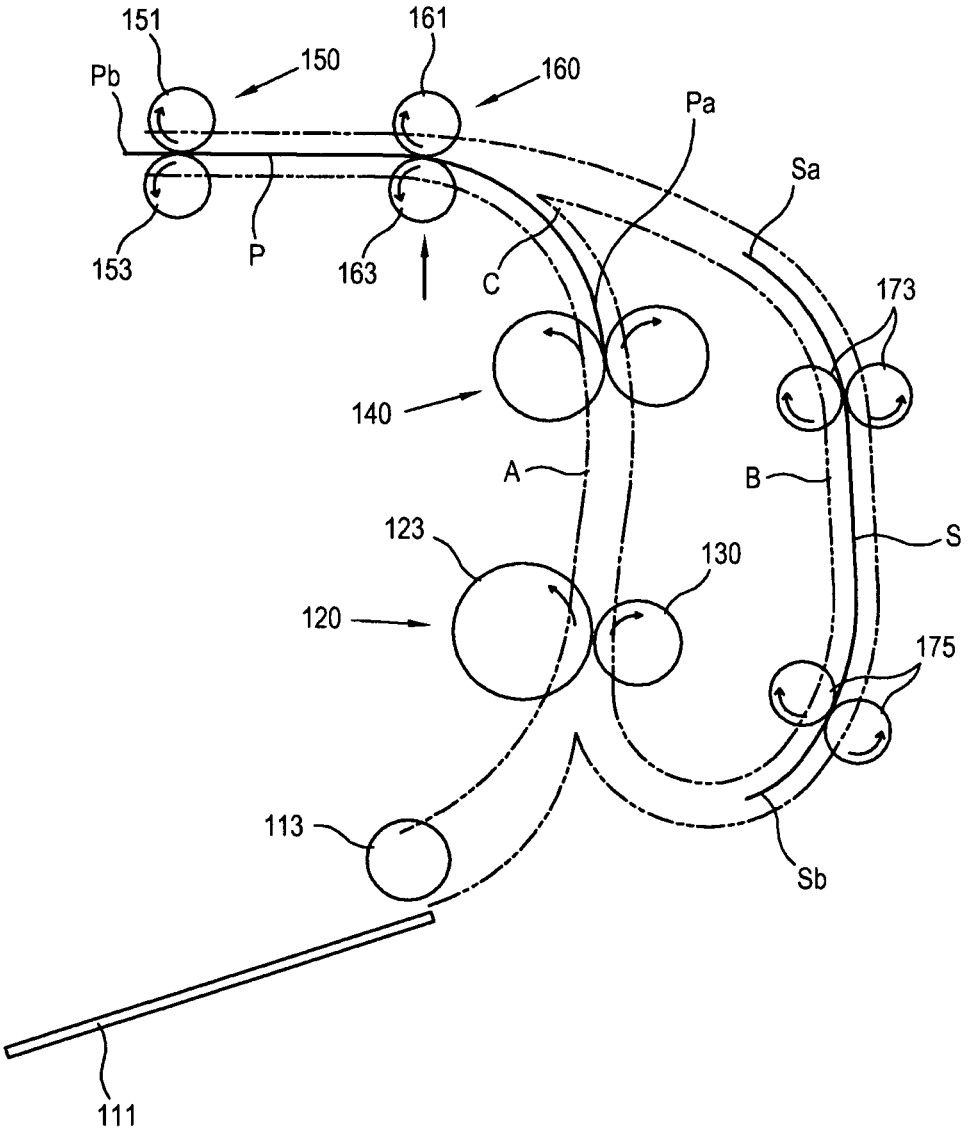

As shown in FIG. 8, the first printing medium P with its rear end portion Pb that has passed through the intermediate conveying unit 160 is discharged out of the apparatus by the discharging roller unit 150, which is being regularly rotated, along the discharging direction, thereby obtaining the resultant duplex-printed first printing medium P.

Figure 9:
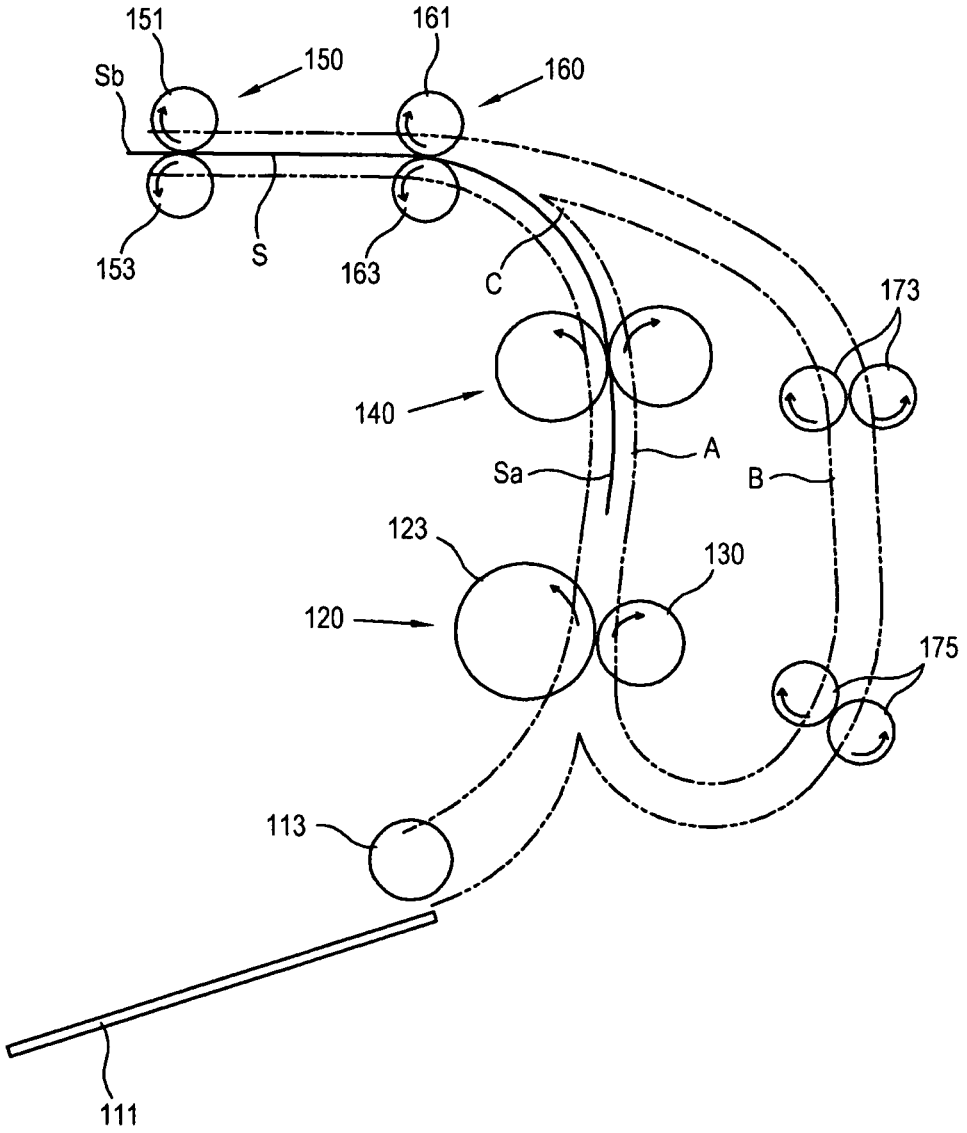

Then, as shown in FIG. 9, the rear side of the second printing medium S under conveyance along the duplex printing path B is printed while the second printing medium S is passed between the image carrier 123 and the transfer roller 130 and through the fixing unit 140.

The resultant duplex-printed second printing medium S can be also discharged by cooperation of the intermediate conveying unit 160 and the discharging roller unit 150 along the discharging direction.

Thus, it is possible to duplex-print a plurality of printing media at a higher printing speed.

In addition, even when a plurality of printing media for duplex printing is conveyed into the image forming apparatus 100, by providing the intermediate unit 160 to selectively hold printing media at an overlapping point and separate the first conveying roller 161 from the second conveying roller 163 when the printing media overlap with each other, it is possible to prevent jamming.

In addition, by shortening the conveying path of the printing media, it is possible to reduce the size of the image forming apparatus 100.

Although at least one embodiment has been shown and described, it will be appreciated by those skilled in the art that changes may be made in these embodiments without departing from the principles and spirit of the invention, the scope of which is defined in the appended claims and their equivalents.

What is claimed is:

1. An image forming apparatus, comprising:

a developing unit to form a visible image, which is formed with a developer, on a printing medium;

a fixing unit to fix the visible image formed on the printing medium onto the printing medium;

a first discharging roller and a second discharging roller to rotate such that the printing medium passed through the fixing unit is conveyed to the developing unit along a duplex printing path when the first discharging roller and the second discharging roller rotate reversely, the first discharging roller and the second discharging roller performing a printing medium discharge operation to discharge the printing medium from the image forming apparatus when the first discharging roller and the second discharging roller rotate forwardly; and an intermediate conveying unit interposed between the fixing unit and the first discharging roller and the second discharging roller at a jointing point of a simplex printing path and the duplex printing path, to selectively hold the printing medium, including a first conveying roller and a second conveying roller, at least one of the first and the second conveying roller being urged in a direction closer with respect to the other of the first and the second conveying rollers, and before or when in a duplex printing mode, at least a portion of a first printing medium overlaps at least a portion of a second printing medium therebetween, being moved in a direction far away with respect to the other of the first and the second conveying rollers to prevent a lam of at least one of the first printing medium and the second printing medium, wherein only one of the first and the second conveying rollers is driven to have a same rotation direction of one of the first discharging roller and the second discharging roller and the other conveying roller is rotatably driven when the first and second conveying rollers are engaged.

2. The image forming apparatus according to claim 1, wherein the first and second conveying rollers are disposed with the printing medium interposed between the first and second conveying rollers; and the intermediate conveying unit includes a driving unit to drive at least one of the first and second conveying rollers such that one of the first and second conveying rollers is selectively distanced from the other.

3. The image forming apparatus according to claim 2, wherein the driving unit includes:

a support lever to support at least one of shafts of the first and second conveying rollers and to selectively distance the first and second conveying rollers from each other; and a solenoid to actuate the support lever.

4. The image forming apparatus according to claim 3, further comprising a control unit to control the driving unit to distance the first conveying roller from the second conveying roller if a first printing medium being conveyed in the duplex printing path overlaps a following second printing medium passed through the fixing unit at a position at which the intermediate conveying unit is disposed.

5. The image forming apparatus according to claim 2, further comprising a control unit to control the driving unit to distance the first conveying roller from the second conveying roller if a first printing medium being conveyed in the duplex printing path overlaps a following second printing medium passed through the fixing unit at a position at which the intermediate conveying unit is disposed.

6. The image forming apparatus according to claim 1, wherein one of the first and second conveying rollers is rotatably moved to be close to and isolated from the other.

7. The image forming apparatus according to claim 1, wherein the first and second conveying rollers are distanced from each other by rotatably moving one of the first and second conveying rollers.

8. The image forming apparatus according to claim 1, wherein the first conveying roller is a driving roller and the second conveying roller is a driven roller which is rotated by relying on the first conveying roller.

9. The image forming apparatus according to claim 1, wherein the first conveying roller is driven to be rotated in the same direction as a driving roller of the discharging roller unit.

10. The image forming apparatus according to claim 1, wherein the first discharging roller and the second discharging roller are a pair of opposing rollers.

11. An image forming apparatus, comprising:

a first discharging roller and a second discharging roller to regularly rotate such that a printing medium passed through a fixing unit is conveyed to a developing unit along a duplex printing path when the first and second discharging rollers rotate reversely, the first and second discharging rollers performing a printing medium discharge operation to discharge the printing medium from the image forming apparatus when the first and second discharging rollers rotate forwardly; and an intermediate conveying unit interposed between the fixing unit and the first and second discharging rollers at a jointing point of a simplex printing path and the duplex printing path, to selectively hold the printing medium, including a first conveying roller and a second conveying roller, at least one of the first conveying roller and the second conveying roller being urged in a direction closer with respect to the other of the first and the second conveying rollers, and before or when in a duplex printing mode, at least a portion of a first printing medium overlaps at least a portion of a second printing medium therebetween, being moved in a direction far away with respect to the other of the first and the second conveying rollers to prevent a jam of at least one of the first printing medium and the second printing medium, wherein only one of the first and the second conveying rollers is driven to have a same rotation direction of one of the first discharging roller and the second discharging roller and the other conveying roller is rotatably driven when the first and second conveying rollers are engaged.

12. A method of improving printing efficiency in an image forming apparatus including a fixing unit, first and second discharging rollers and an intermediate conveying unit, between the fixing unit and the first and second discharging rollers at a jointing point of a simplex printing path and a duplex printing path, including a first conveying roller and a second conveying roller, comprising:

regularly rotating the first and the second discharging rollers to discharge printing medium; and selectively holding the printing medium at an overlapping point of a first sheet of the printing medium and a second sheet of the printing medium with the intermediate conveying unit, wherein only one of the first and the second conveying rollers is driven to have a same rotation direction of one of the first discharging roller and the second discharging roller and the other conveying roller is rotatably driven when the first and second conveying rollers are engaged, wherein at least one of the first and the second conveying roller is urged in a direction closer with respect to the other of the first and the second conveying rollers, and before or when in a duplex printing mode, at least a portion of a first printing medium overlaps at least a portion of a second printing medium therebetween, moved in a direction far away with respect to the other of the first and the second conveying rollers to prevent a jam of at least one of the first printing medium in the second printing medium.

* * * * *

UNITED STATES PATENT AND TRADEMARK OFFICE

CERTIFICATE OF CORRECTION

PATENT NO. : 9,284,157 B2
APPLICATION NO. : 12/923440
DATED : March 15, 2016
INVENTOR(S) : Jung-yun Won It is certified that error appears in the above-identified patent and that said Letters Patent is hereby corrected as shown below:

Claims

Claim 1, Column 7, Line 46:
Delete "lam" and insert -- jam --, therefor.

Signed and Sealed this
Fourteenth Day of June, 2016

Michelle K. Lee

Michelle K. Lee
*Director of the United States Patent and Trademark Office*